US006216380B1

(12) United States Patent
McGarity, Jr. et al.

(10) Patent No.: US 6,216,380 B1
(45) Date of Patent: Apr. 17, 2001

(54) BREECH PLUG PRIMER CAP ADAPTER

(75) Inventors: William D. McGarity, Jr., Atlanta, GA (US); Julian Echeberria, Bergara (ES)

(73) Assignee: Blackpowder Products, Inc., Norcross, GA (US)

( * ) Notice: Subject to any disclaimer, the term of this patent is extended or adjusted under 35 U.S.C. 154(b) by 0 days.

(21) Appl. No.: 09/521,814

(22) Filed: Mar. 9, 2000

(51) Int. Cl.[7] ..... F41C 9/08
(52) U.S. Cl. ..... 42/51; 42/84
(58) Field of Search ..... 42/51, 83

(56) References Cited

U.S. PATENT DOCUMENTS

| | | | | |
|---|---|---|---|---|
| 5,402 | * | 12/1847 | Rector | 42/51 |
| 879,225 | * | 2/1908 | Wheeler | 89/27.13 |
| 905,997 | * | 12/1908 | Dawson et al. | 89/20.2 |
| 1,468,891 | * | 9/1923 | Tucker | 42/77 |
| 2,307,009 | * | 1/1943 | Adelman | 89/1.3 |
| 2,340,047 | * | 1/1944 | Dunn | 89/1.3 |
| 2,469,660 | * | 5/1949 | Martin | 416/2 |
| 2,504,162 | * | 4/1950 | Summerbell et al. | 89/27.13 |
| 2,531,483 | * | 11/1950 | Summerbell et al. | 89/27.13 |
| 4,222,191 | * | 9/1980 | Lee et al. | 42/51 |
| 4,227,330 | * | 10/1980 | Chapin | 42/51 |
| 4,232,468 | * | 11/1980 | Chapin | 42/51 |
| 4,437,249 | * | 3/1984 | Brown et al. | 42/51 |
| 4,888,901 | * | 12/1989 | French et al. | 42/51 |
| 5,010,677 | * | 4/1991 | Verney Carron | 42/77 |
| 5,133,143 | * | 7/1992 | Knight | 42/51 |
| 5,408,776 | * | 4/1995 | Mahn et al. | 42/51 |
| 5,487,232 | * | 1/1996 | Osborne et al. | 42/51 |
| 5,561,934 | * | 10/1996 | Knight | 42/51 |
| 5,623,779 | * | 4/1997 | Rainey, III | 42/51 |
| 5,632,109 | * | 5/1997 | Caudle | 42/51 |
| 5,644,861 | * | 7/1997 | Knight | 42/51 |
| 5,755,053 | * | 5/1998 | Oakley | 42/51 |

* cited by examiner

*Primary Examiner*—Darren W. Ark
(74) *Attorney, Agent, or Firm*—Pepe & Hazard LLP

(57) ABSTRACT

A cap adapter breech plug for muzzle loading firearms utilizes a cylindrical plug with barrel and breech ends and having a passage extending axially therethrough, a coaxial counterbore about the passage at the breech end of the plug, an axial slot along the side of the counterbore, and an exhaust passage extending generally radially from the passage adjacent the inner end of the counterbore to the outer surface of the plug for exhausting gases from the axially extending passage. A spring seated in the plug has a portion extending through the axial slot and into the counterbore to bear resiliently against the casing of a cap seated in the counterbore to retain it in the plug.

17 Claims, 3 Drawing Sheets

BREECH PLUG PRIMER CAP ADAPTER

BACKGROUND OF THE INVENTION

The present invention relates to muzzle loading firearms and, more particularly, to breech plugs which adapt the firearm to utilize percussion caps as the ignition means.

As is well known, percussion caps are preferred for ignition of the black powder charge in muzzle loading firearms, and various types of nipples using such caps have been developed. With the increasing use of inline firing systems because of better ignition characteristics, there has been a move to use primer or percussion caps in breech plugs providing such an inline firing system. Shotgun shell primer caps have been considered highly advantageous for use in such inline ignition systems.

There have been a number of breech plug constructions to adapt the muzzle loading firearm to use a primer cap which is detonated by a firing pin. The hot gases from the detonated primer cap travel in a passage through the plug to ignite the black powder at the barrel end of the breech plug. Exemplary of such structures are those illustrated in Carron U.S. Pat. No. 5,010,677 granted Apr. 30, 1991; Mahn et al U.S. Pat. No. 5,408,776 granted Apr. 25, 1995; and Osborne et al U.S. Pat. No. 5,487,232 granted Jan. 30, 1996.

The problems encountered in such breech plug adapters have included (i) holding the primer cap in the plug, (ii) expansion or deformation of the casing of the cap by the hot gases so as to make it difficult to remove from the plug, and (iii) contamination of the firing mechanism by the particles in the exhaust gases. Although it is necessary that the cap be securely seated in the plug, it is also necessary to be able to extract it readily from the plug.

It is an object of the present invention to provide a novel breech plug adapter for seating firing caps in an inline firing system for a muzzle loading firearm.

It is also an object to provide such a breech plug adapter which may be fabricated readily and relatively economically.

Another object is to provide such a breech plug adapter which seats the firing cap securely but avoids a tight friction fit which would make removal difficult upon expansion or deformation of the casing of the cap.

A further object is to provide such a breech plug adapter which diverts a substantial portion of the exhaust gases radially to the periphery of the plug to minimize distorting pressures on the casing of the cap and contamination of the bolt or other firing assembly.

SUMMARY OF THE INVENTION

It has now been found that the foregoing and related objects may be readily attained in a cap adapter breech plug for muzzle loading firearms which has a cylindrical plug with barrel and breech ends. A passage extending axially through the plug and a coaxial counterbore is provided about the passage at the breech end of the plug. An axial slot extends along a side of the counterbore and an exhaust passage extends generally radially from the passage adjacent the inner end of the counterbore to the outer surface of the plug for exhausting gases from the axially extending passage. A spring member is seated in the plug and has a portion extending through the axial slot and into the counterbore to bear resiliently against the casing of a cap seated in the counterbore to hold it in place.

Generally, the plug includes a well in the breech end adjacent to and communicating with the slot, and the spring has a body which is seated in the well and the aforementioned portion extends from one end of the body into the slot and into the counterbore. This portion of the spring is preferably of generally C-shaped configuration with its center section extending into the counterbore.

Desirably, the breech end of the plug also has a shallow channel extending radially from the well to the outer surface of the plug, and the body of the spring is of generally U-shaped configuration with an arm portion extending from its other end which is seated in the shallow channel.

Generally, the exhaust passage comprises a radially disposed exhaust channel extending to the outer periphery of the plug from a depth below the inner end of the counterbore. Desirably, it extends diametrically across the width of the plug and has a bottom wall which slopes downwardly from its outer end to the axis of the plug.

In a preferred embodiment, the bottom wall has a trough centrally thereof which extends to a depth below the inner end of the counterbore. In another embodiment, the exhaust passage comprises a radially extending bore extending from the coaxial passage below the counterbore.

The breech end of the plug also has a collar about the counterbore, and the breech plug has a body portion which is externally threaded for threaded engagement in the barrel of the firearm.

DETAILED DESCRIPTION OF THE PREFERRED EMBODIMENT

Figure 1:
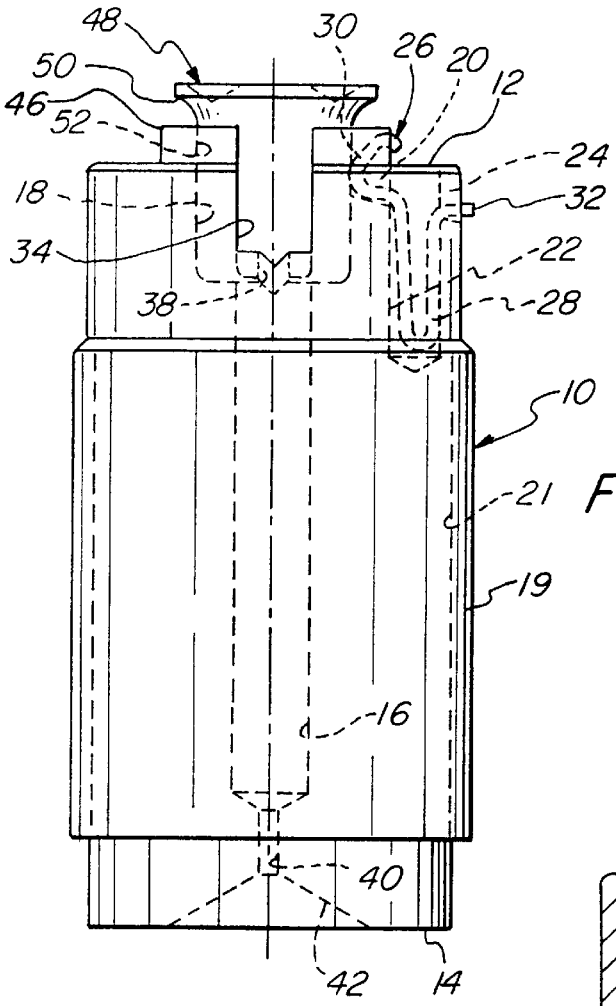
FIG. 1 is a side elevational view of a cap adapter breech plug embodying the present invention with a shotgun primer cap seated therein.
Figure 2:
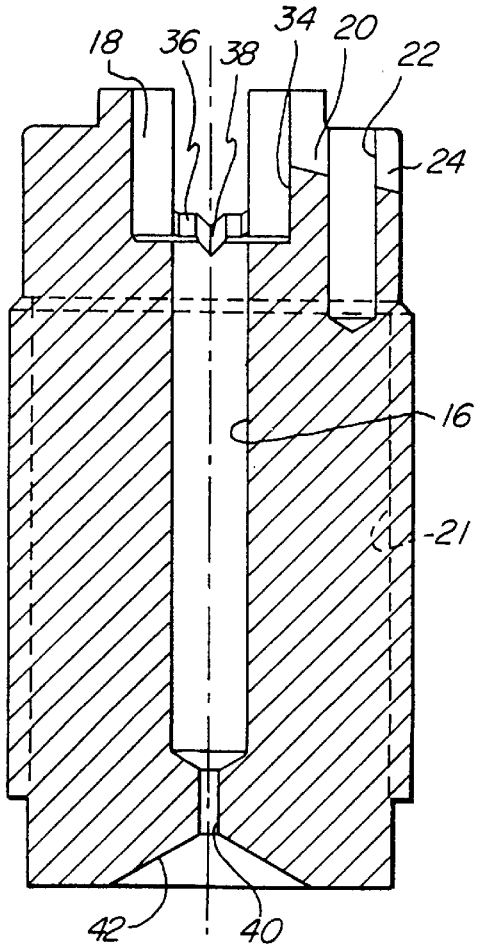
FIG. 2 is a cross sectional view of the breech plug of FIG. 1 and with the primer cap removed.
Figure 3:
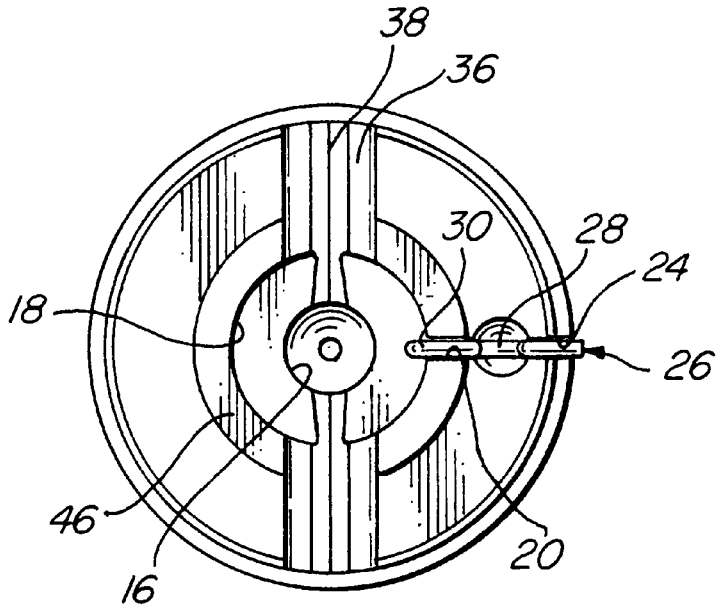
FIG. 3 is a plan view of the breech end of the plug.
Figure 4:
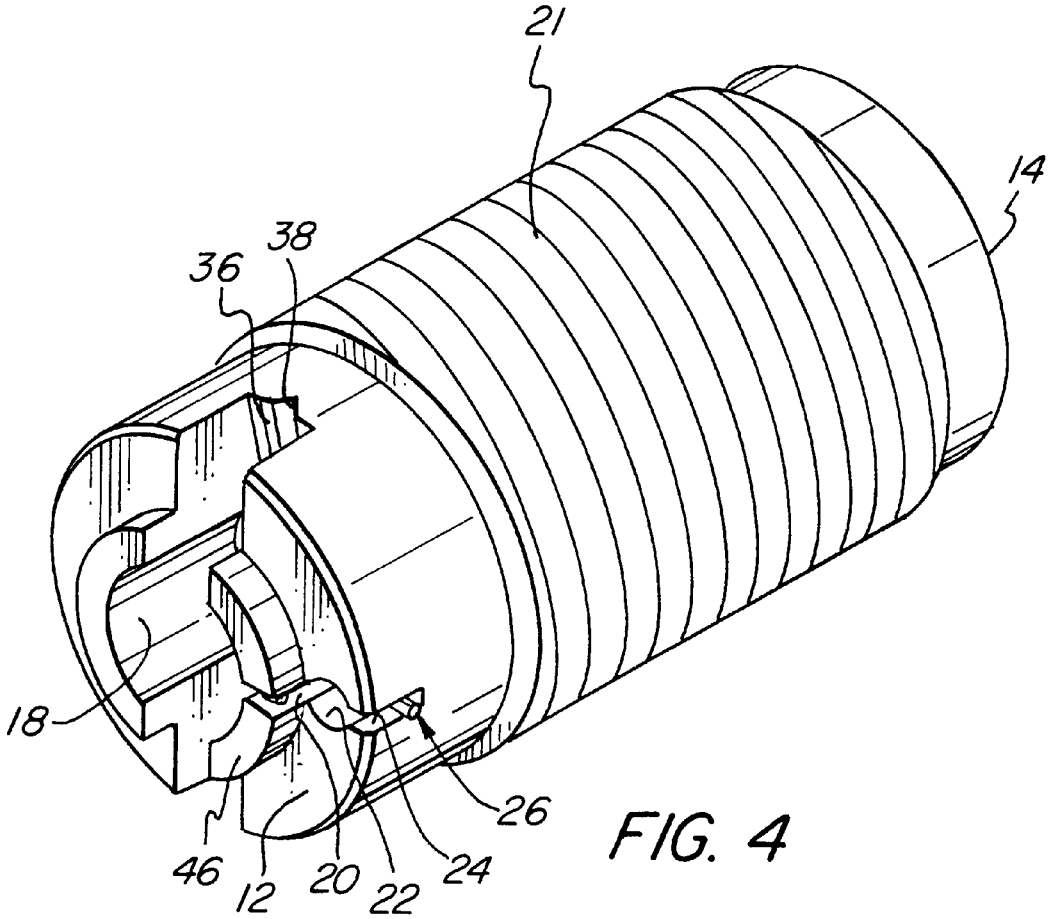
FIG. 4 is a perspective view of the breech plug.
Figure 5:
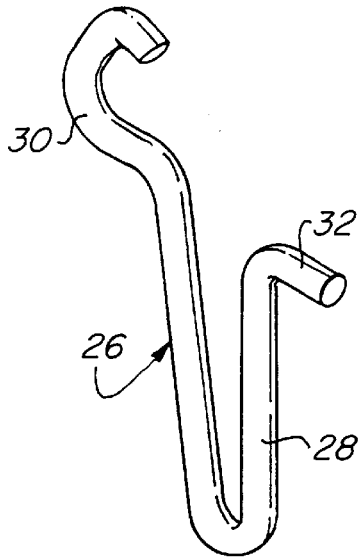
FIG. 5 is a side elevational view of the spring employed in the breech plug.

FIGS. 1–4 illustrate a breech plug cap adapter embodying the present invention includes of a generally cylindrical breech plug generally designated by the numeral 10 with a breech end 12 and a barrel end 14. A passage 16 extends coaxially therethrough and a counterbore 18 is provided in the breech end 12. The exterior surface of most of the body 19 of the breech plug is threaded as indicated by the dotted lines 21 extending axially for engagement with internal threads in the barrel of the firearm (not shown).

A relatively shallow slot 20 extends radially from the counterbore 18 to a deeper well 22, and a shallow channel 24 extends from the well 22 to the periphery of the plug 10, all in radial alignment. Seated in the well 22 is the U-shaped body portion 28 of a spring generally designated by the numeral 26. Extending from one leg of the body portion 28 is generally a C-shaped end portion 30 which seats in the slot 20 and partially extends into the counterbore 18. Extending laterally from the other leg of the body portion 28 is an arm 32 which seats in the shallow channel 24.

Extending diametrically across the breech end 12 of the plug 10 is a channel 34 which has a bottom wall 36 which slopes inwardly from the outer periphery to the axis of the plug 10. The bottom wall has a groove 38 which extends to a point below the inner end of the counterbore 18 at the axis of the plug 10.

Adjacent the barrel end 14 of the plug 10 the passage 16 has a reduced diameter portion 40 and the barrel end 14 has a conical recess 42 about the passage 16.

The breech end 12 of the plug 10 has upstanding collar portions 46 about the counterbore 18. As seen in FIG. 1, the rim 50 of the primer cap generally designated by the numeral 48 is spaced a short distance above the collar portions 46 to facilitate extraction of the spent cap. The casing 52 of the cap 48 fits snugly within the counterbore 18 and provides a chamber there within containing the primer powder charge (not shown).

Figure 6:
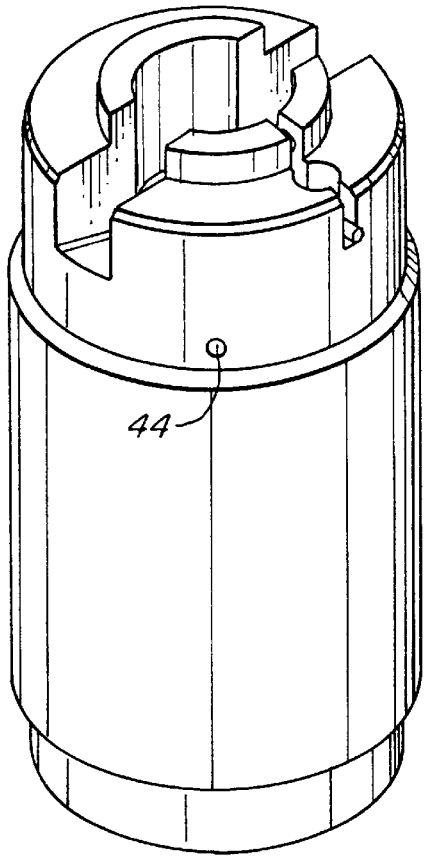
FIG. 6 is a perspective view of a breech plug utilizing another embodiment of gas exhaust passage.
Figure 7:
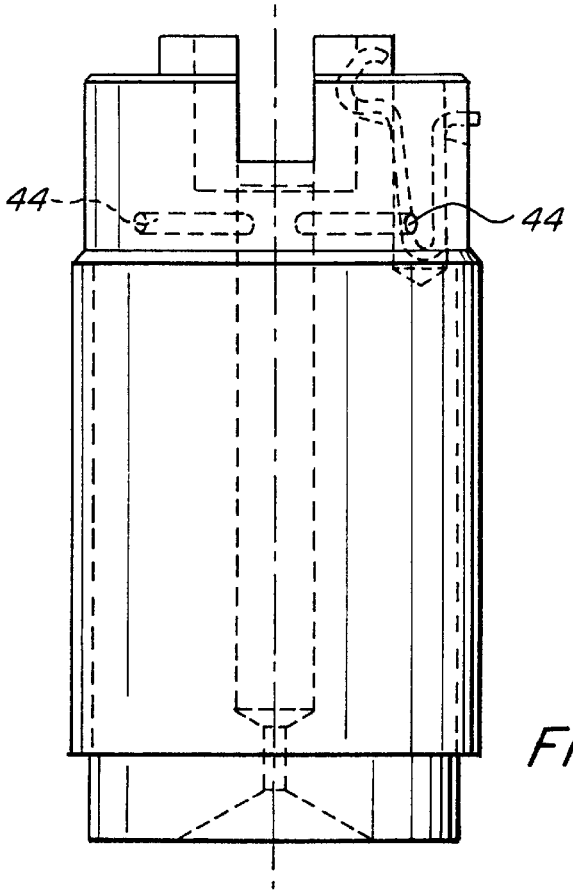
FIG. 7 is a cross sectional view of the breech plug of FIG. 6.

In the embodiment of FIGS. 6 and 7, the exhaust passage comprises bores 44 extending radially from the coaxial passage 16 to the exterior of the plug.

When the firing pin on the bolt (not shown) of the firearm strikes the cap 48, the powder charge therein is ignited and the flash extends through the passage 16 to the propellant powder charge (not shown) in the recess 42 to effect its ignition. The hot exhaust gases moving outwardly along the passage 16 are largely diverted into the channel 34 or through the bores 44 seen in FIG. 6 and thus do not expand the casing 52 or drive the cap into the firing pin. Moreover, diverting the exhaust gases away from the bolt assembly reduces its contamination. This also minimizes wear and corrosion of the firing mechanism.

In the present invention the counterbore can be dimensioned closely to the diameter of the casing of the firing cap seated therein but not to the point of frictional engagement. This allows some expansion of the casing by the exhaust gases without making extraction difficult. Generally, this will require a clearance of about 0.15 mm.

The C-shaped portion of the leaf spring resiliently bears on the casing side wall to retain it securely within the counterbore despite the clearance.

The breech plug is readily fabricated from bar stock and easily machined to provide the various slots, channels, passages, etc. The plug securely threads into the barrel of the firearm and is easily removed when so desired by engaging a wrench in the channel 34. The spent cap can be removed readily from the breech plug by insertion of a tool under the rim of the cap and prying it outwardly.

Thus, it can be seen that the novel breech plug adapter of the present invention may be readily and economically fabricated to securely seat the primer cap while permitting its facile removal after firing. The hot gases from the powder ignition which travel back through the coaxial passage are largely oriented radially to the exterior of the plug rather than passing into and about the casing of the cap.

Having thus described the invention what is claimed is:

1. A cap adapter breech plug for muzzle loading firearms comprising:

(a) a cylindrical plug with barrel and breech ends and having
  (i) a passage extending axially therethrough;
  (ii) a coaxial counterbore about said passage at the breech end of said plug;
  (iii) an axial slot along a side of said counterbore; and
  (iv) an exhaust passage extending generally radially from said passage adjacent the inner end of said counterbore to the outer surface of said plug for exhausting gases from said axially extending passage; and (b) a spring member seated in said plug and having a portion extending through said axial slot and into said counterbore to bear resiliently against the casing of a cap when the cap is seated in said counterbore.

2. The cap adapter breech plug in accordance with claim 1 wherein said plug includes a well in said breech end adjacent to and communicating with said slot, said spring having a body which is seated in said well and a portion which extends from one end of said body into said slot and into said counterbore.

3. The cap adapter breech plug in accordance with claim 2 wherein said portion of said spring is of generally C-shaped configuration with its center section extending into said counterbore.

4. The cap adapter breech plug in accordance with claim 3 wherein said breech end of said plug has a shallow channel extending radially from said well to the outer surface of said plug, and wherein the body of said spring is of generally U-shaped configuration with an arm portion extending from the other end of said body seated in said shallow channel.

5. The cap adapter breech plug in accordance with claim 1 wherein said exhaust passage comprises a radially disposed exhaust channel extending to the outer surface of said plug from a depth below the inner end of said counterbore.

6. The cap adapter breech plug in accordance with claim 5 wherein said exhaust channel extends diametrically across the width of said plug.

7. The cap adapter breech plug in accordance with claim 5 wherein said exhaust channel has a bottom wall which slopes downwardly from an outer end of said channel to the axis of said plug.

8. The cap adapter breech plug in accordance with claim 7 wherein said bottom wall has a trough centrally thereof which extends to a depth below the inner end of said counterbore.

9. The cap adapter breech plug in accordance with claim 1 wherein said exhaust passage comprises a radially extending bore extending from said axially extending coaxial passage below said counterbore.

10. The cap adapter breech plug in accordance with claim 1 wherein said breech end of said plug has a collar about said counterbore.

11. The cap adapter breech plug in accordance with claim 1 wherein said breech plug has a body portion which is externally threaded for threaded engagement in the barrel of a firearm.

12. A cap adapter breech plug for muzzle loading firearms comprising:

(a) a cylindrical plug with barrel and breech ends and having a body portion which is externally threaded for threaded engagement in the barrel of a firearm, said body portion having
  (i) an axially extending passage therethrough;
  (ii) a coaxial counterbore at the breech end of said plug;
  (iii) an axial slot along a side of said counterbore;
  (iv) an exhaust channel extending generally radially from said passage adjacent an inner end of said counterbore to an outer surface of said plug for exhausting gases from said passage; and
  (v) a collar on said breech end about said counterbore; and (b) a spring member seated in said plug having a portion extending through said slot and into said counterbore to bear resiliently against the casing of a cap when the cap is seated in said counterbore.

13. The cap adapter breech plug in accordance with claim 12 wherein said exhaust channel extends diametrically across a width of said plug, said exhaust channel having a bottom wall which slopes downwardly from an outer end of said channel to the axis of said plug.

14. The cap adapter breech plug in accordance with claim 13 wherein said bottom wall has a trough centrally thereof which extends to a depth below the inner end of said counterbore.

15. The cap adapter breech plug in accordance with claim 12 wherein said exhaust channel comprises a radially extending bore extending from said axially extending passage at a depth below said counterbore.

16. A cap adapter breech plug for muzzle loading firearms comprising:

(a) a cylindrical plug with barrel and breech ends and having a body portion which is externally threaded for threaded engagement in the barrel of a firearm, said body portion having (i) a passage extending axially therethrough;

(ii) a coaxial counterbore about said passage at the breech end of said plug;

(iii) an axial slot along a side of said counterbore;

(iv) a well in said breech end adjacent to and communicating with said axial slot; and (v) an exhaust passage extending generally radially from said passage adjacent an inner end of said counterbore to an outer surface of said plug for exhausting gases from said axially extending passage; and (b) a spring member seated in said well of said plug and having a portion extending from one end of said body through said axial slot and into said counterbore to bear resiliently against the casing of a cap seated in said counterbore, said portion of said spring being of generally C-shaped configuration with a center section extending into said counterbore.

17. The cap adapted breech plug in accordance with claim 16 wherein said breech end of said plug has a shallow channel extending radially from said well to the outer surface of said plug, and wherein the body of said spring is of generally U-shaped configuration with an arm portion extending from its other end seated in said shallow channel.

* * * * *